US005195143A

United States Patent [19]

Spiegel et al.

[11] Patent Number: 5,195,143

[45] Date of Patent: Mar. 16, 1993

[54] ACOUSTICAL RIBBON TRANSDUCER LOUDSPEAKER SYSTEM

[75] Inventors: Leo Spiegel, Sharon; Mark B. Nazar, Bellingham, both of Mass.

[73] Assignee: Apogee Acoustics, Inc., Randolph, Mass.

[21] Appl. No.: 708,919

[22] Filed: May 31, 1991

[51] Int. Cl.[5] ..... H04R 25/00; H04R 31/00; H04R 7/00

[52] U.S. Cl. ..... 381/201; 381/202; 381/203; 29/594; 181/164

[58] Field of Search ..... 381/201, 202, 203, 176, 381/190, 191; 29/594, 609.1; 181/163, 164, 157, 168, 173; 310/324

[56] References Cited

U.S. PATENT DOCUMENTS

| | | | |
|---|---|---|---|
| 3,164,686 | 1/1965 | Tibbetts | 381/202 |
| 3,832,499 | 8/1974 | Heil | 381/203 |
| 4,273,968 | 6/1981 | Suyama | 381/202 |
| 4,354,066 | 10/1982 | Necoechea | 381/202 |
| 4,395,592 | 7/1983 | Colangelo | 381/203 |
| 4,550,228 | 10/1985 | Walker et al. | 381/203 |

FOREIGN PATENT DOCUMENTS

| | | | |
|---|---|---|---|
| 0738864 | 10/1955 | United Kingdom | 381/176 |

*Primary Examiner*—James L. Dwyer
*Assistant Examiner*—Jason Chan
*Attorney, Agent, or Firm*—Robert F. O'Connell

[57] ABSTRACT

A loudspeaker system using ribbon transducer elements wherein the ribbon elements of the high and mid-range transducer units form a plurality of conductive circuits separated by spaces, or cuts, therebetween which have substantially smooth, undulating wave forms. The magnetic circuit return paths thereof are arranged so as to be remote from and out of the transmitting paths of the acoustic signals generated at such units and the surfaces of the magnetic circuit components and a baffle structure associated therewith are shaped to reduce diffraction effects in the acoustic signals therefrom. A woofer ribbon element has a plurality of interconnected conductive circuit regions to form a generally serpentine shaped circuit, which regions are separated by channels, or cuts, each of which has a smooth, undulating wave form.

6 Claims, 4 Drawing Sheets

ACOUSTICAL RIBBON TRANSDUCER LOUDSPEAKER SYSTEM

INTRODUCTION

This invention relates generally to loudspeaker systems and, more particularly, to such systems which use acoustical ribbon transducers.

BACKGROUND OF THE INVENTION

High performance loudspeakers employ what is often referred to as a "force over area" concept to reduce the unwanted structural vibrations encountered in the older and more popular dynamic cone speakers. Such force over area loudspeakers which use metallic ribbon elements positioned in a magnetic field or plastic diaphragms positioned in an electric field are well known to those in the art and have been demonstrated to have advantages compared to cone speakers.

Ribbon and electro-static loudspeakers, however, although minimizing the level of unwanted, structural vibrations evident in cone speakers, still produce some undesirable structural vibrations and acoustical diffraction effects which are caused by the manner in which the magnetic or electric fields are mechanically implemented and the mechanization of the ribbon or electric drive diaphragm.

An example of a speaker configuration using ribbon elements is described in U.S. Pat. No. 4,550,228, issued on Oct. 29, 1985 to Walker et al. The system disclosed therein comprises high frequency (tweeter), mid-range frequency, and low frequency (woofer) ribbon transducer units. While the structure thereof performs reasonably well, the ribbon structures and magnetic field implementations thereof utilize mechanical elements and relatively sharp diffracting surfaces between the acoustical ribbon transducer driver elements and the listener which physically interfere with the desired acoustic signal output therefrom. Such implementations cause an undesirable coloration or distortion of the acoustical output, i.e., the acoustical output signal includes undesirable signal components due to nonlinearities, undesired resonances or other frequency dependent effects, mechanical compression effects, noise, and the like. In addition, the ribbon transducer elements themselves exhibit adverse structural effects associated with various different structural design approaches used in such speakers. Examples of such approaches include the use of a simple corrugated thin metallic ribbon used with an array of damped suspension supports on the edges of the ribbon, the use of a corrugated plastic/metallic laminated ribbon used with an integral plastic suspension array brought out to the edges thereof, the use of a foam suspension array for ribbon support, and the use of a laminated ribbon used with a group of spaced rectangular conductors for impedance matching. Such structures have been found to add unwanted distortion to the acoustical output which it is desired to minimize, or eliminate, if possible.

Accordingly, it is an object of the present invention to provide an improved loudspeaker system which provides an accurate high resolution reproduction of sound over the full acoustic range thereof with a reduced level of coloration or distortion.

It is yet another object of the invention to produce a improved ribbon speaker system having reduced ribbon structural resonances and distortions typically found in prior art cone or electric and magnetic planar field speakers.

It is yet another object of the invention to produce an improved ribbon speaker system having reduced physical interferences with the acoustical output signal and having reduced diffraction effects arising from any baffling and/or the return magnetic circuit path structures used in the system.

BRIEF SUMMARY OF THE INVENTION

An improved speaker system is achieved in accordance with the invention by using an integrated ribbon speaker system consisting of three ribbon transducer units for reproducing high, mid-range, and low frequency acoustic signals, respectively.

The tweeter, or high frequency, transducer unit comprises a single relatively narrow, horizontally-corrugated, ribbon element. The ribbon element is divided into two conductive circuit portions wherein the shape of the space between the adjoining conductor circuits is in the form of generally smooth, undulating wave. The ribbon element is positioned vertically and attaches only at its top and bottom ends to a rigid elongated frame. The frame has a relatively long and narrow, but open, rectangular geometry surrounding the ribbon element. The rectangular opening of the frame through which the output acoustic signals is transmitted has no interfering elements, such as cross bars normally used for return magnetic circuit path return purposes, or for any other structural reasons. The ribbon element is driven by the action of an alternating current driver source which interacts with a shaped magnetic field. A tweeter baffling structure is also mounted on the frame and is shaped so as to have smooth surfaces at both the front and back thereof to assist in providing a relatively diffuse and free fluidic air flow of the output acoustic signal both in the forward and rearward directions from the ribbon element through the open rectangular frame structure. The structural magnetic circuit return paths normally located in back and/or in front of the ribbon in prior art designs are eliminated. Instead, a magnetic return path is provided by a steel magnetic backing and top and bottom support structures. In addition, a significant reduction in adverse diffraction effects is achieved by suitably shaping the surface of the magnetic elements that are used and by the use of the aforesaid front and back baffling structure to further smooth the air flow from the ribbon. In the case of longer ribbons in excess of approximately two feet, for example, a soft suspension may be introduced to aid in centering the ribbon.

The mid-range transducer unit comprises an elongated corrugated ribbon element mounted in rigid elongated frame having a construction similar to that of the tweeter element. However, the mid-range ribbon element utilizes a larger number (e.g., six) of longitudinal ribbon conductor circuits oriented in the plane of the ribbon element. The conductor circuits are separated by spaces which are formed in the shape of smooth, undulating waves and are located between sets of magnets which are designed to provide a shaped magnetic field providing for both centering of the magnetic field and improved stability. As above, in the case of longer ribbons in excess of approximately two feet, for example, a soft suspension may be used to aid in centering the ribbon.

The low frequency, or woofer, transducer unit uses a relatively broad elongated trapezoidal-shaped, horizontally-corrugated ribbon element that is supported on all sides and is mounted vertically in a rigid, elongated frame to provide a single magnetic circuit path through the ribbon element. The ribbon element comprises a plurality of conductor circuits separated by a series of horizontal spaces, or cuts, therein each having a generally smooth serpentine or undulating pattern. The spaces, for example, are preferably shaped in the form of a repeating generally sinusoidal wave pattern that improves the structural dynamics of the woofer ribbon element. The ribbon element is located directly in front of a rectangular array of magnets mounted on a perforated steel backing sheet.

Such a loudspeaker structure utilizing the improved ribbon transducer unit configurations for each of the tweeter and mid-range frequency transducer unit provides a smooth, unimpeded air flow path for the output acoustical signal in the forward and rearward direction from the speaker so as to provide a signal to the listener in which distortions have been minimized.

DESCRIPTION OF THE INVENTION

The structure of the invention represents an improvement over the system of the type shown in the aforesaid Walker et al. patent and utilizes the general structure as shown therein, said patent being incorporated by reference to complete the description of the invention herein.

Figure 1:
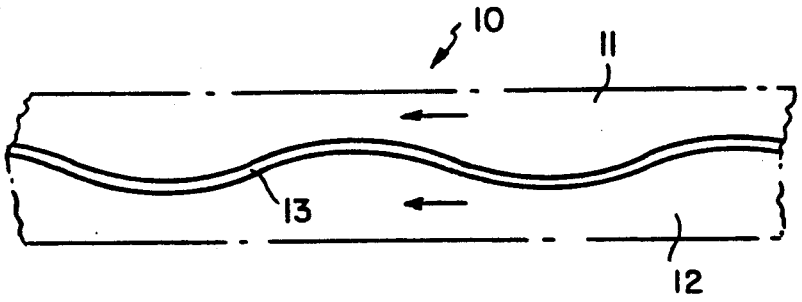
FIG. 1 shows a frontal view of a portion of a tweeter ribbon transducer element in accordance with the invention.

The tweeter transducer unit is similar to that shown in FIG. 9 of the Walker et al. patent. In accordance with the invention, however, the ribbon transducer element depicted therein is configured as shown in the portion thereof depicted in FIG. 1 herein. As can be seen in FIG. 1, the ribbon element 10 comprises a pair of conductive circuits 11 and 12 (the current flow being shown by the arrows) separated by a space or cut 13 which has a smooth, undulating wave shape. The ribbon element has horizontal corrugations as shown in the Walker et al. patent, but for simplicity not shown in FIG. 1.

Figure 6:
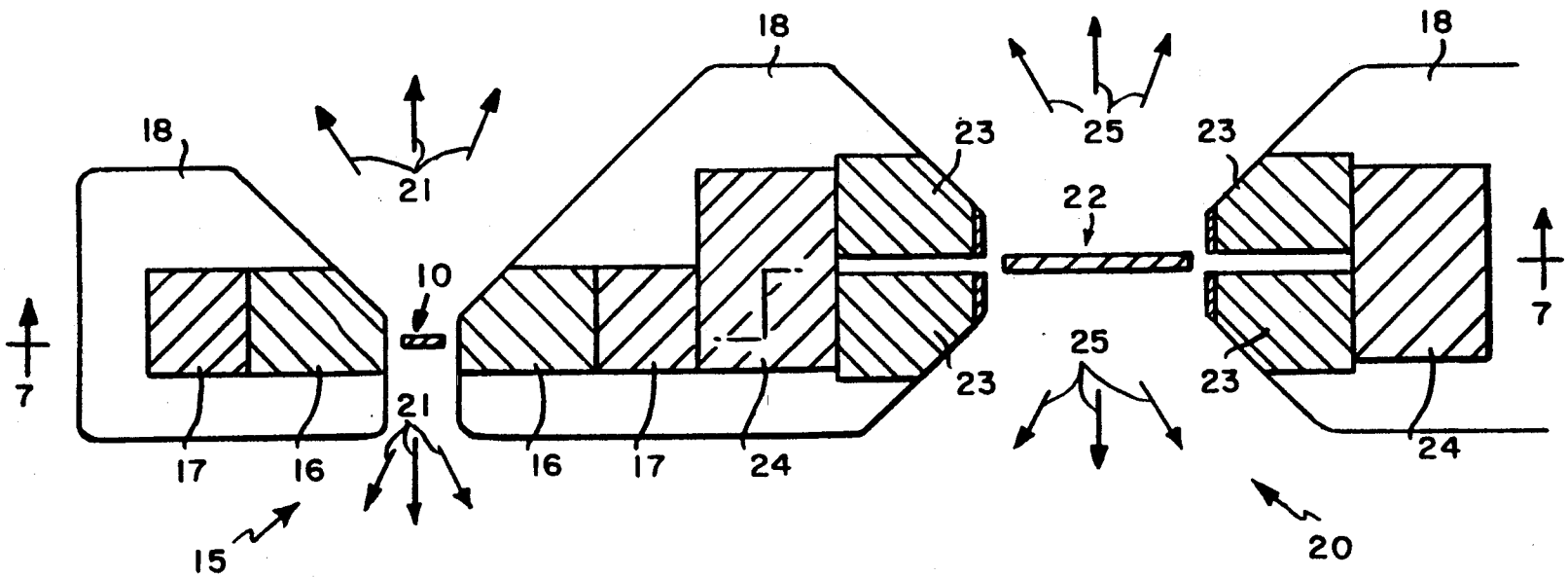
FIG. 6 shows a view in section of portions of the tweeter and mid-range ribbon transducer units of the invention including the ribbon elements together with baffling means and magnetic circuit structures associated therewith.
Figure 7:
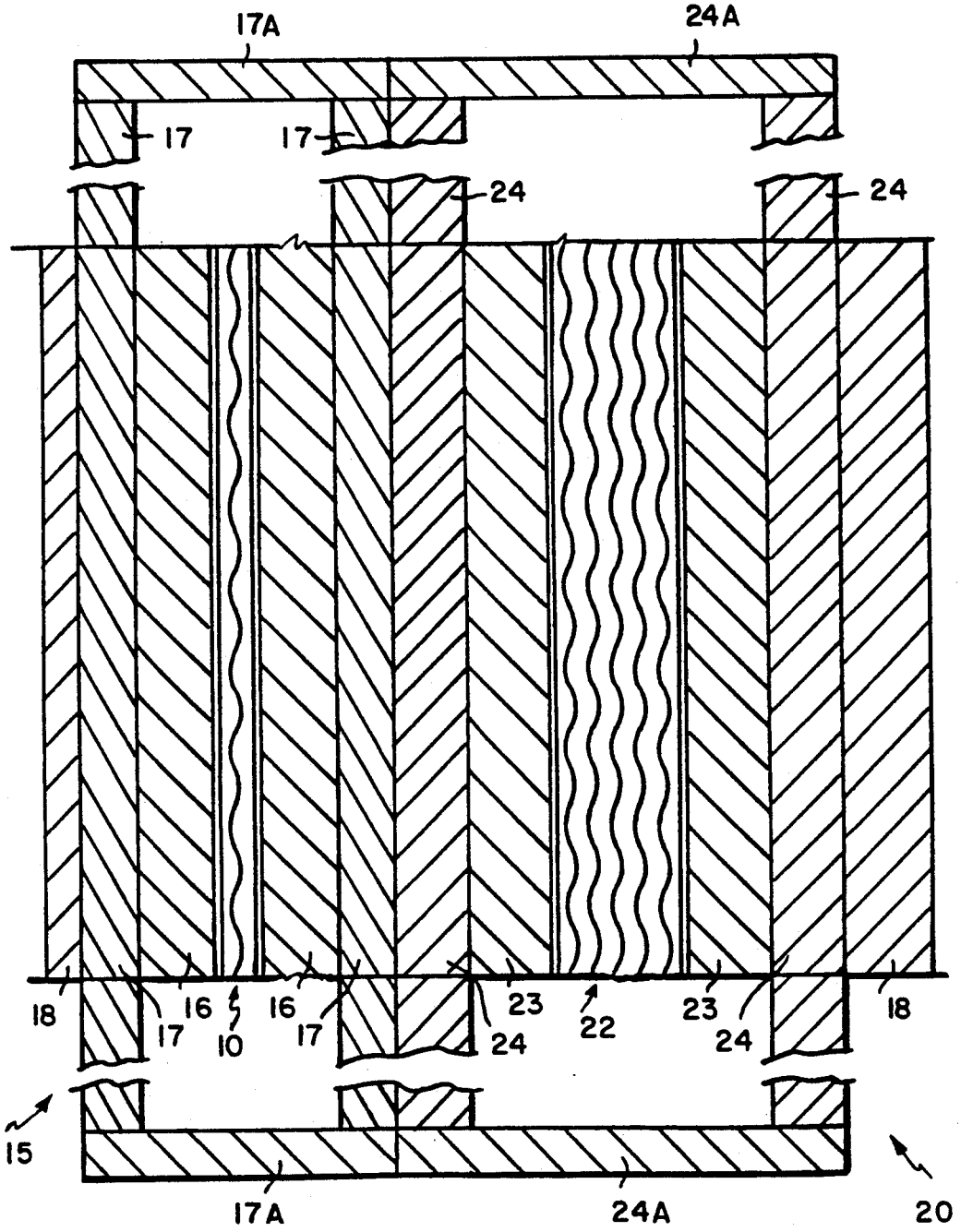
FIG. 7 shows a vertical sectional view of portions of the tweeter and mid-range ribbon transducer units of FIG. 6 along the line 7—7 thereof.

The ribbon element is attached to the support frame at the top and bottom ends of the ribbon only and the elongated vertical edges or sides thereof are not attached to the support frame as shown in the Walker et al. patent. The ribbon element comprises an aluminum sheet adhered to a plastic backing via an adhesive layer (not shown) to form a laminate structure. Views of a tweeter unit 15 using such a ribbon element 10 are shown in FIGS. 6 and 7 which depict the relative positions of the components thereof. As seen therein, a pair of shaped magnets 16 are positioned adjacent ribbon element 10 to establish a magnetic field passing through the ribbon in a direction substantially perpendicular to the plane of the ribon so that the magnetic intensity increases in a direction perpendicular to the plane of the ribbon on either side of the center region thereof.

A portion of the magnetic return path for the magnetic field generated by magnets 16 is formed by steel member portions 17 which are mounted adjacent magnets 16. Baffle structures 18 formed of non-conductive material, e.g., wood, are used for smoothing the flow of the acoustic signals from the front and rear of the ribbon element 10 as shown by arrows 21 in FIG. 6 for the tweeter unit 15, as well as for the mid-range unit 20, described below. The magnets 16 and baffle structures 18 are shaped so that no sharp edges are present in the path of the front and rear acoustic signals which are transmitted in the directions of arrows 21. The magnetic circuit return path is completed by extending steel member portions 17 upwardly and downwardly from the ribbon element and by using steel cross bars 17A, well above and below the overall structure shown in FIG. 7 so as to be remote from and out of the front and rear paths of the acoustic signals, as shown in FIG. 7. Thus, no physical impediment is present and no sharp diffracting edges are present in such path to distort the frontward and rearward acoustic signals shown by arrows 21 of FIG. 6.

Figure 2:
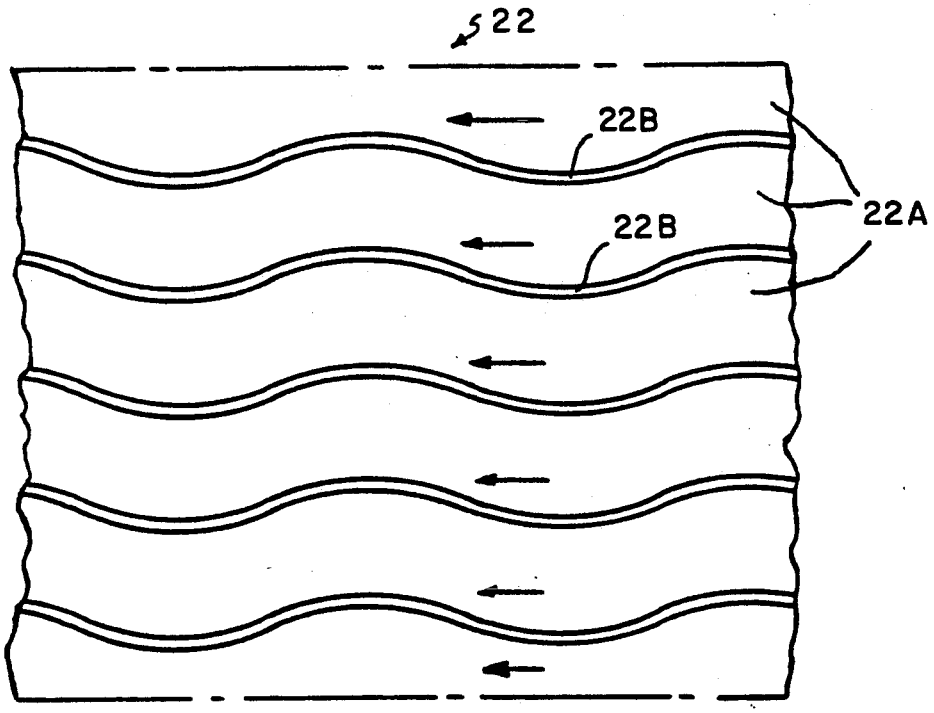
FIG. 2 shows a frontal view of a portion of a mid-range ribbon transducer element in accordance with the invention.

The mid-range transducer unit 20 is also shown in FIGS. 6 and 7. As can be seen therein, a ribbon element 22 of the type depicted in FIG. 2 is mounted between magnets 23. The ribbon element comprises a plurality of conductive circuits 22A (the current flow being shown by the arrows) separated by spaces, or cuts, 22B each of which has a smooth, undulating shape. Steel portions 24 are mounted adjacent to and in contact with split magnets 23 for completing the magnetic circuit path. In a similar manner to the tweeter unit, as shown in FIG. 7, the magnetic circuit path is completed by extending the steel members 24 upwardly and downwardly from ribbon element 22 and by using steel cross bars 24A, well above and below the overall structure so as to be remote from and out of the path of the mid-range front and rear acoustic signals as shown by arrows 25 in FIG. 6. As in the tweeter unit, the baffle structures 18 associated with the mid-range unit are shaped to smooth the flow of the acoustic signals from the front and rear of ribbon element 22. The surfaces of both the magnets 23 and baffles 18 are shaped so as to avoid the presence of sharp edges to reduce any diffraction effects which would thereby occur if such edges were not rounded off. Such a structure which, as in the tweeter unit, has no impediments present in front and in back of ribbon element 22 and which has no diffracting surfaces in the path of the front and rear acoustic signals therefrom avoids or substantially reduces the distortions in such signals that are normally produced in prior structures.

Figure 5:
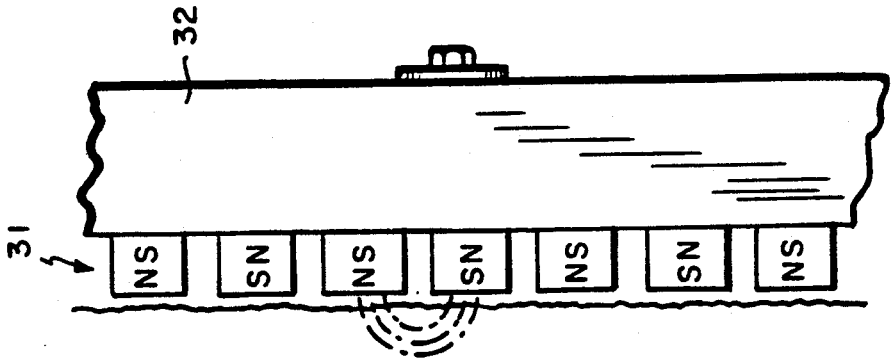
FIG. 5 shows a sideview of a portion of the woofer transducer unit of FIG. 3.
Figure 4:
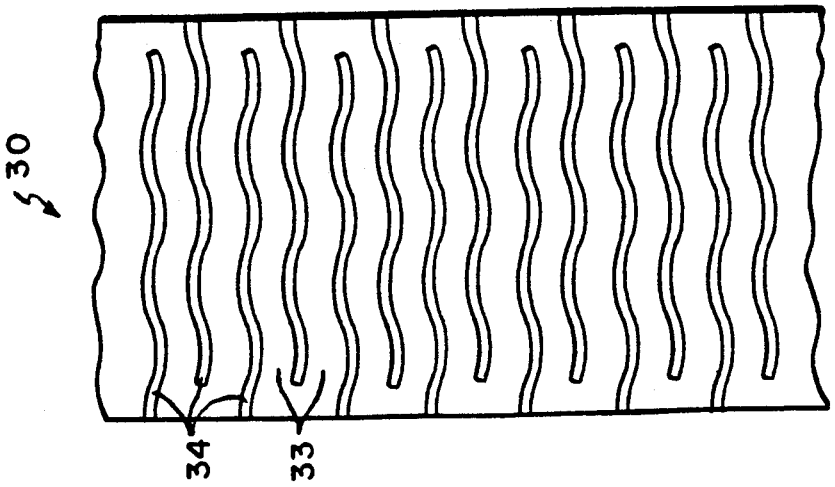
FIG. 4 shows a more detailed frontal view of a portion of the woofer ribbon element of the unit shown in FIG. 3.
Figure 3:
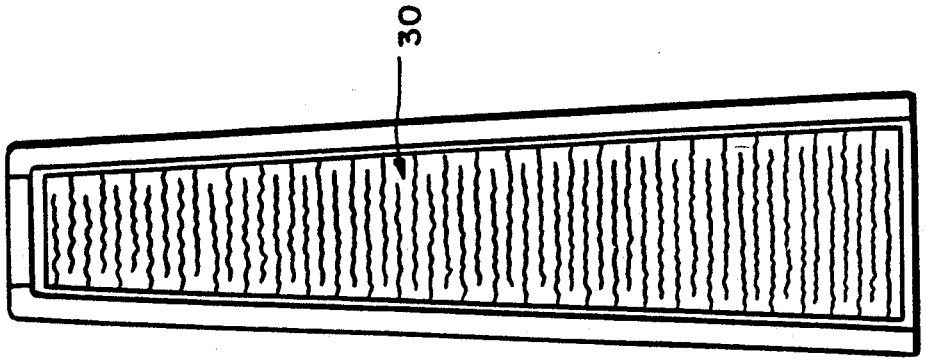
FIG. 3 shows a frontal view of a woofer ribbon transducer unit in accordance with the invention.

The low frequency, or woofer, unit is substantially similar to the low frequency unit shown in the aforesaid Walker et al. patent (FIGS. 4, 5 and 6 of the patent being effectively reproduced as FIGS. 3, 4 and 5 herein). As described in the patent, such structure comprises two upright support members, one being perpendicular to the base and the other being at an angle to the base member. A structure element is mounted on one upright support member and another structure is mounted on the other upright support member, respectively, as described in the patent.

A ribbon element 30 of trapezoidal shape is attached on each vertical edge to a respective stretcher element and held in tension therebetween by a suitable spring mechanism (not shown) as described in the patent. Ribbon element 30 is supported in a magnetic field produced by a trapezoidal array of permanent magnets 31 mounted on a backing plate 32 attached to the support members. The ribbon element 30, a portion of which is shown in FIG. 4, is in the form of a conductive sheet having a plurality of interconnected circuit portions, or regions, 33, which are separated by channels, or cuts, 34 therebetween which, in this improved woofer ribbon structure, are each shaped to produce a smooth, undulating waveform as depicted in FIG. 4. Such configuration forms a generally serpentine conductive path in said ribbon element as depicted by the arrows in FIG. 4. The presence of such undulating channels reduces the distortions which were normally present in the low frequency acoustic signals in the straight cut channels shown in the structure of the Walker et al. patent and, hence, improves the woofer output sound quality.

Accordingly, the tweeter, mid-range, and woofer transducer units described above and depicted in the figures provides an overall improvement in sound quality of the overall output acoustic signal over the audio frequency spectrum. No structures are present in the signal paths between the ribbon elements, which produce the front and rear acoustic signals at the high and mid-range frequencies, and the listener, and no sharp diffraction edges are present in the signal paths thereof. Accordingly, coloration or distortions in the acoustic signals thereof are substantially reduced. Such structures and the use of undulating channels in the ribbon element of the woofer unit provides an overall signal which is of much superior quality to that produced by the structures shown in the aforesaid Walker et al. patent.

What is claimed is:

1. An electromagnetic transducer unit for reproducing and transmitting acoustic signals along a transmission path therefrom comprising a supporting frame;

an elongated, flexible conductive ribbon element being supported by said supporting frame and having a plurality of separate electrically conductive circuits, said circuits being separated by a space therebetween having a substantially smooth, undulating shape;

magnetic circuit means including magnet means for generating a magnetic field passing through said ribbon element; and means for shaping said magnetic field in the direction substantially perpendicular to the plane of said ribbon element so that the magnetic intensity of said field increases in a direction perpendicular to the plane of said ribbon element on either side of a center region thereof.

2. An electromagnetic transducer unit in accordance with claim 1 wherein said magnetic circuit means includes a magnetic circuit return path formed by a conductive member positioned so as to be remote from and out of the transmission path for the acoustic signals transmitted by said transducer unit so that the transmission of said acoustic signals is not impeded by said magnetic circuit return path.

3. An electromagnetic transducer unit in accordance with claim 1 wherein said magnetic circuit means and said supporting frame are shaped to minimize diffraction effects on said acoustic signals and further including baffling means positioned adjacent said magnetic circuit and shaped to further minimize said diffraction effects.

4. An electromagnetic transducer unit in accordance with claims 1, 2, or 3 wherein said unit is a high frequency transducer unit and said ribbon element comprises two conductive circuits separated by a space therebetween having a smooth, undulating shape.

5. An electromagnetic transducer unit in accordance with claims 1, 2, or 3 wherein said unit is a mid-range frequency transducer unit and said ribbon element comprises more than two conductive circuits separated by spaces therebetween each having smooth, undulating shapes.

6. An electromagnetic transducer unit for use in a low frequency range comprising a supporting frame;

a conductive ribbon element being supported by said supporting frame and having a plurality of interconnected conductive regions forming a generally serpentine conductive path, said conductive regions having non-conductive spaces extending therebetween, each of said spaces having a substantially smooth, undulating shape; and magnetic circuit means for generating a magnetic field passing through said ribbon element.

* * * * *